US007744374B2

(12) United States Patent
Hoelscher et al.

(10) Patent No.: US 7,744,374 B2
(45) Date of Patent: Jun. 29, 2010

(54) SLIDING CONTACT RETAINING DEVICE

(75) Inventors: Peter Hoelscher, Staufenberg (DE); Bernd Becker, Heuchelheim (DE); Peter Zilch, Berlin (DE)

(73) Assignee: Schunk Bahn-und Industrietechnik GmbH, Wettenberg (DE)

( * ) Notice: Subject to any disclaimer, the term of this patent is extended or adjusted under 35 U.S.C. 154(b) by 64 days.

(21) Appl. No.: 12/200,536

(22) Filed: Aug. 28, 2008

(65) Prior Publication Data

US 2010/0055956 A1 Mar. 4, 2010

(30) Foreign Application Priority Data

Aug. 27, 2008 (DE) ..... 10 2008 039 862

(51) Int. Cl.
*H01R 39/00* (2006.01)

(52) U.S. Cl. ..... 439/28; 439/21; 310/40 R; 310/232

(58) Field of Classification Search ..... 439/20, 439/21, 519–521, 28, 29, 18; 310/40 R, 310/219, 231–232
See application file for complete search history.

(56) References Cited

U.S. PATENT DOCUMENTS 3,105,728 A * 10/1963 Seeloff ..... 439/29
3,163,792 A * 12/1964 Sayers ..... 310/102 R
3,905,664 A * 9/1975 Baldoni ..... 439/26
4,566,744 A * 1/1986 Engelenburg et al. ..... 439/5

* cited by examiner

*Primary Examiner*—Khiem Nguyen
(74) *Attorney, Agent, or Firm*—Schwegman, Lundberg & Woessner, P.A.

(57) ABSTRACT

In a sliding contact retaining device for a contacting device of a rotor, the rotor can have a plurality of slip rings, wherein the contacting device serves to retain the sliding contact retaining device, and wherein an electrical contact can be established between the slip rings of the rotor and sliding contacts of the sliding contact retaining device, wherein using the sliding contact retaining device, sliding contact retainers can be disposed in a first and a second serial arrangement parallel to a rotational axis of the rotor, and wherein adjacently arranged slip rings can be contacted alternately from a sliding contact of the first serial arrangement and a sliding contact of the second serial arrangement, wherein the sliding contact retaining device has at least one holding device for receiving at least two serial arrangements of sliding contact retainers.

19 Claims, 4 Drawing Sheets

SLIDING CONTACT RETAINING DEVICE

RELATED APPLICATION

The present application claims priority under 35 U.S.C. 119 to German Utility Application No. 10 2008 039 862.4, filed Aug. 27, 2008, which is hereby incorporated by reference.

This document describes a sliding contact retaining device for a contacting device of a rotor, wherein, in an example, the rotor has a plurality of slip rings, wherein the contacting device serves to retain the sliding contact retaining device, and wherein an electrical contact can be established between the slip rings of the rotor and sliding contacts of the sliding contact retaining device, wherein by means of the sliding contact retaining device, sliding contact retainers are disposed in a first and a second serial arrangement parallel to a rotational axis of the rotor, and wherein adjacently arranged slip rings can be contacted alternately from a sliding contact of the first serial arrangement and a sliding contact of the second serial arrangement.

Sliding contact retaining devices of this type can be employed, for instance for transmitting electrical energy and electrical signals respectively from a fixed contacting device to a rotor of a rotating shaft of a generator or electric motor. In particular in wind turbines, a plurality of independent electrical signals can be transmitted via a rotating shaft, for instance for adjustment of the blades. A series of electrically separated slip rings are arranged adjacently on a circular cylindrical, peripheral surface of the shaft, whereby a relative distance between the slip rings is kept relatively small, for instance as a result of the space available in a wind turbine. The slip ring arrangement is surrounded by the fixed contacting device, which is formed essentially by two ring-shaped carrier plates having an interposed sliding contact retaining device. The sliding contact retaining device comprises sliding contact retainers, which serve to retain the sliding contact, and to produce a contact pressure by resiliently moving the sliding contact, for each sliding contact on the respectively assigned slip ring. The sliding contact retainers can be disposed in a serial arrangement parallel to a rotational axis of the rotor, and are individually retained between the carrier plates, for instance at rods, and are screwed thereto. Since the slip rings are arranged relatively close to one another, and a sliding contact cross-section essentially covers a width of the slip ring, it may not be feasible to dispose all of the sliding contact retainers in a single serial arrangement, because a mean distance of two adjacently arranged sliding contact retainers is larger than a mean distance of two slip rings, in consequence of the necessary sliding contact retainer housings. Consequently, one approach can form a first serial arrangement and a second serial arrangement of sliding contact retainers with sliding contacts, whereby adjacently arranged slip rings are contacted alternately from a sliding contact of the first serial arrangement and a sliding contact of the second serial arrangement. The respective serial arrangements are then arranged on rods respectively provided to this end, spaced at a distance from one another in the circumferential direction of the rotor. For this purpose, the retainers are adjusted individually to the respectively assigned slip ring, and are screwed to the rods.

For transmitting high currents and for enhancing operational reliability, one approach can be to employ for each slip ring and for each phase respectively two sliding contact retainers for the purpose of enlarging the contact cross-section by employing two sliding contacts. Thus, a contacting device can have four serial arrangements of sliding contact retainers, which are each uniformly arranged along a circumference of the slip ring arrangement and the rotor respectively. Two sliding contacts and sliding contact retainers respectively, which contact a slip ring, are then connected via a current bridge.

One drawback of certain examples of the sliding contact retaining device lies in the relatively large amount of work involved in maintenance and cleaning respectively. As a consequence, it can be necessary to detach each individual sliding contact retainer from the carrying rods of the contacting device, to remove the electrical connections and the current bridge as well as the sliding contact retaining housing itself by loosening the screws, in order to be able to replace, for instance a graphite sliding contact. Such a maintenance procedure is to be performed in an especially cumbersome and consequently time and cost consuming fashion if the sliding contact retaining device is installed in a wind turbine. Since the sliding contact retaining device is composed of a comparatively high number of individual components, the production of a sliding contact retaining device is, besides the time consuming maintenance, likewise relatively laborious and expensive. What may also occur is that along the circumference of the slip ring, sliding contact wear debris may become deposited on sliding contact retainers arranged below a rotational axis, as a result of arranging the sliding contact retainers along the circumference of the slip rings, thereby increasing the risk of flashovers. In addition, forming a plurality of serial arrangements of sliding contact retainers spaced at a distance from one another, causes that the slip ring arrangement is covered over a comparatively large area, thereby obstructing the dissipation of frictional heat, for instance by air cooling.

Thus, in an example, a proposed sliding contact retaining device can be formed of comparatively few components in a compact manner, and enabling cost effective production and maintenance.

In an example, this task can be solved by a sliding contact retaining device, such as described herein.

In an example, the proposed sliding contact retaining device can be disposed for a contacting device of a rotor having a plurality of slip rings, wherein the contacting device serves to retain the sliding contact retaining device, and wherein an electrical contact can be established between the slip rings of the rotor and the sliding contacts of the sliding contact retaining device, wherein using the sliding contact retaining device, sliding contact retainers are disposed in a first and in a second serial arrangement parallel to a rotational axis of the rotor, and wherein adjacently arranged slip rings can be contacted alternately from at least one sliding contact of the first serial arrangement and at least one sliding contact of the second serial arrangement, wherein the sliding contact retaining device has at least one holding device for respectively receiving at least two serial arrangements of sliding contact retainers.

In contrast to certain other approaches, the sliding contact retainers are thus not directly connected by rods of the contacting device, but are rather retained by the holding device. This enables the formation of defined serial arrangements of sliding contact retainers by means of the holding device, thereby rendering a modular structure of the sliding contact retaining device attainable.

In contrast to this, according to certain other approaches, there is formed a serial arrangement of sliding contact retainers by means of an individual and thus individually displaceable fixing of the sliding contact retainers at a rod and carrier respectively. The holding device of the sliding contact retaining device according to the invention enables the formation of two parallel serial arrangements of sliding contact retainers, which are spaced at a distance from one another in the circumferential direction of the slip rings. Consequently, in an example of a minimum configuration of a contacting device, a proposed sliding contact retaining device having merely one holding device can be used for contacting slip rings of a rotor with the respectively essential number of sliding contacts. In this manner, maintenance and cleaning respectively of the sliding contact retaining device can be significantly reduced, for merely one holding device having all sliding contact retainers has to be detached in one piece. Thus, detachment of individual sliding contact retainers, as used in other approaches, can be omitted. In light of the fact that the serial arrangements of the sliding contact retaining device are besides arranged at a comparatively close distance from one another using the holding device, the formation of special current bridges for bridging an air gap of sliding contact retainers, which are arranged along the circumference of the slip ring arrangement, can be dispensed with. Hence, the number of components of the sliding contact retaining device can be comparatively low, in contrast with certain other approaches of sliding contact retaining devices, thereby significantly decreasing the amount of manufacture work and maintenance. Moreover, a covering of a circular cylindrical peripheral surface of the slip ring arrangement is also comparatively small, thereby enabling enhanced cooling of the slip rings.

In an example, the sliding contact retaining device is also suitable for enhancing available contacting devices. Thus, one can merely detach old sliding contact retainers, which are individually mounted in serial arrangements, and replace them by a holding device having sliding contact retainers received therein, such as to render a sliding contact retaining device as a whole easier to maintain.

In an example, the sliding contact retaining device can have at least two holding devices. Thus, a total of four serial arrangements of sliding contact retainers can be positioned at a slip ring arrangement, whereby two sliding contacts are contacted with a slip ring, hence rendering a particularly large contact area for transmitting currents, and an enhanced operational reliability respectively, attainable.

It can be particularly advantageous, in an example, to have the holding devices arranged relative to one another at an radial angle $\beta$ of for instance 90° in relation to the rotational axis. Consequently, on the one hand, good accessibility to the holding device can be obtained, and on the other hand, already available supplies for connecting the sliding contact retaining device can be employed if individually arranged sliding contact retainers are replaced by sliding contact retainers retained in the holding devices.

In an example, a holding device can respectively form a first and a second serial arrangement. The sliding contact retainers of the serial arrangements can then each be arranged in axial direction staggered relative to one another, in such a way that all slip rings can be contacted with a holding device In an example, a holding device can each form two first or two second serial arrangements. The sliding contact retainers of the two serial arrangements can then be oriented without being axially staggered relative to one another, and on a respectively joint circumferential circle. Thus, use of special current bridges of the sliding contact retaining device for bridging an air gap can thus be omitted. There may be formed, if desired, a short connection line merely between two adjacent sliding contact retainers.

Thus, there may be provided also a joint supply connection for sliding contact retainers of a phase at the holding device. A joint supply connection can significantly reduce demounting and mounting of a holding device, since only one electrical connection has to be demounted and mounted respectively for two sliding contact retainers.

In order to enhance the operational reliability of the sliding contact retaining device and to prevent a flashover by, for instance, deposited dustlike sliding contact wear debris on sliding contact retainers or electrically conductive components of the sliding contact retaining device, it can be particularly advantageous if the holding device is disposed in installation position above the rotational axis. Any sliding contact wear debris as well as other particles or parts that may potentially be produced, are then entering into a region below the rotational axis, as a result of their gravitational force, and can in this region be collected. Since there is no holding device provided below the rotational axis, in an example, contamination of the same can be effectively prevented by means of a holding device being arranged above, such as previously described.

If the holding device is formed of a dielectric material, any additional electrical insulation of the sliding contact retainers can be omitted, thereby further reducing a required number of components. The dielectric material can have a high stability and may be mechanically stable.

This is also the case if the holding device is formed in one piece. The holding device can then, for instance be made from a piece of material.

It can also be advantageous if the holding device forms sliding contact retainer receptacles for receiving the sliding contact retainers. Thus, standardized sliding contact retainers of basically similar type can be employed, which are inserted into correspondingly formed sliding contact retainer receptacles or are connected to them. The sliding contact retainer receptacles can be formed in such a way that the sliding contact receptacles can be received in a positive and/or force-fitting fashion without the need for any additional fixing elements.

In an advantageous example, the sliding contact retainer receptacles of the holding device can be formed as through holes. Through holes are particularly easy to manufacture, whereby the sliding contact retainers may thus correspondingly be formed cylindrically and may be easily fixed by using press-fitting or a thread disposed in the through hole.

A sliding contact retainer and orientation of the sliding contacts being longitudinally movable orthogonal to the rotational axis of the slip rings is rendered possible if the sliding contact retainer receptacles of the holding device are formed in such a manner that a longitudinal axis of the sliding contact retainer receptacles intersect the rotational axis. In this way, uniform wearing of a sliding contact surface can be obtained.

In order to further reduce the manufacturing costs of the sliding contact retaining device, the sliding contact retainers may each have a housing, which is formed of a hollow profile. Hollow profiles can be obtained at low cost and may be easily cut to a desired length for the production of a sliding contact retainer, thereby enabling a sliding contact to be received and to be correspondingly mounted within the hollow profile. Additionally, the hollow profile can also be connected to the holding device in such a manner that replacement of a sliding contact through an open end of the hollow profile, which is accessible from above, is enabled. Demounting of the sliding contact retainer can hence be dispensed with, since the sliding contacts can easily be removed from the sliding contact retainer. Furthermore, the sliding contact retainer can then also be formed comparatively long, thereby rendering possible use of sliding contacts, which are enlarged in their length. Hence, longer operating times of sliding contacts can be attained, thereby in turn advantageously prolonging maintenance intervals.

If the housing of the sliding contact is electrically conductive, there can be formed a connection at the housing. Consequently, further formation of one or several connections between the sliding contact and the housing, and between the housing and a supply respectively, can be omitted. The sliding contact can be contacted with the housing such as using reception in the conductive housing alone, such that at the housing only one connection of a supply is required.

It can be particularly advantageous if the holding device has a fixing device for fixing of the holding device at carrier elements of the contacting device. The holding device can be separated from the contacting device jointly with the sliding contact retainers in one step by detaching the fixing device from the contacting device, and can thus be replaceable in a particularly rapid fashion.

In an example, the fixing device can have axially extending grooves in one surface of the holding device, wherein carrier elements of the contacting device can be inserted into the grooves. Therefore, the grooves can be formed in a shape and orientation that conforms to the carrier elements of the contacting device. The fixing device can thus enable a positive connection of the holding device with the carrier elements, whereby for the manufacture of which there is no need for any particular mounting efforts. In particular, if the carrier elements are formed as two rods oriented parallel in the axial direction, the grooves can be formed in an U shape on a lower surface of the holding device, which faces the slip rings.

Moreover, the fixing device can form fixing holes in the holding device, which enable a detachable fixing of the holding device at the carrier elements. The fixing holes can serve for the formation of a pinned, screwed, clamped or locked connection with the carrier elements. Any mounting or dismounting of the holding device and the carrier elements respectively is hence possible in a particularly easy fashion.

In an example, the holding device can have an adjusting device by means of which an axial position of the sliding contacts can be adjusted relative to the slip rings. An adjusting device can for instance be formed by a displaceable arrester or by means of a simple screw arranged at a frontal side of the holding device, whereby the adjusting device then enables easy adjustment of the sliding contact positions. A sliding contact retaining device can also be formed with two holding devices, whereby the holding devices can be formed identically. A desired displacement of the serial arrangements of sliding contact retainers can then be realized by various adjustments of the respective adjustment devices of the holding device.

In order to effectively prevent the formation of leakage currents between sliding contact retainers, the holding device can have grooves on one surface, which extend between sliding contact retainers.

In this document, the present devices and methods will be discussed in greater detail with reference to the accompanied drawing, whereby:

Figure 1:
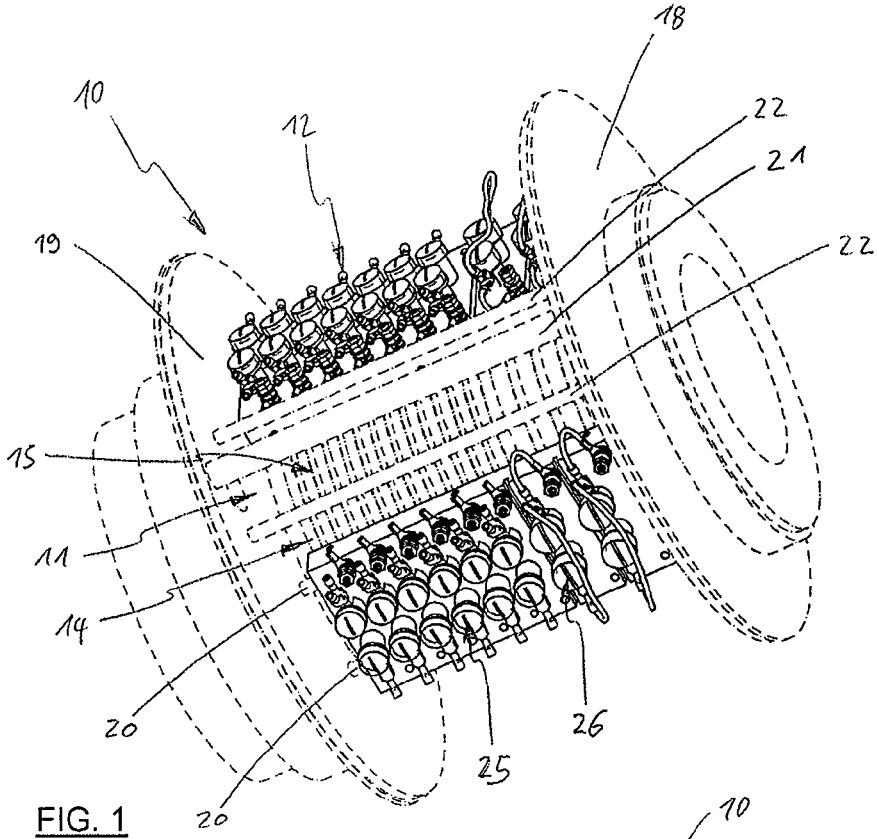
FIG. 1 shows an example of a contacting device jointly with a rotor in a first embodiment of a sliding contact retaining device in perspective view.
Figure 2:
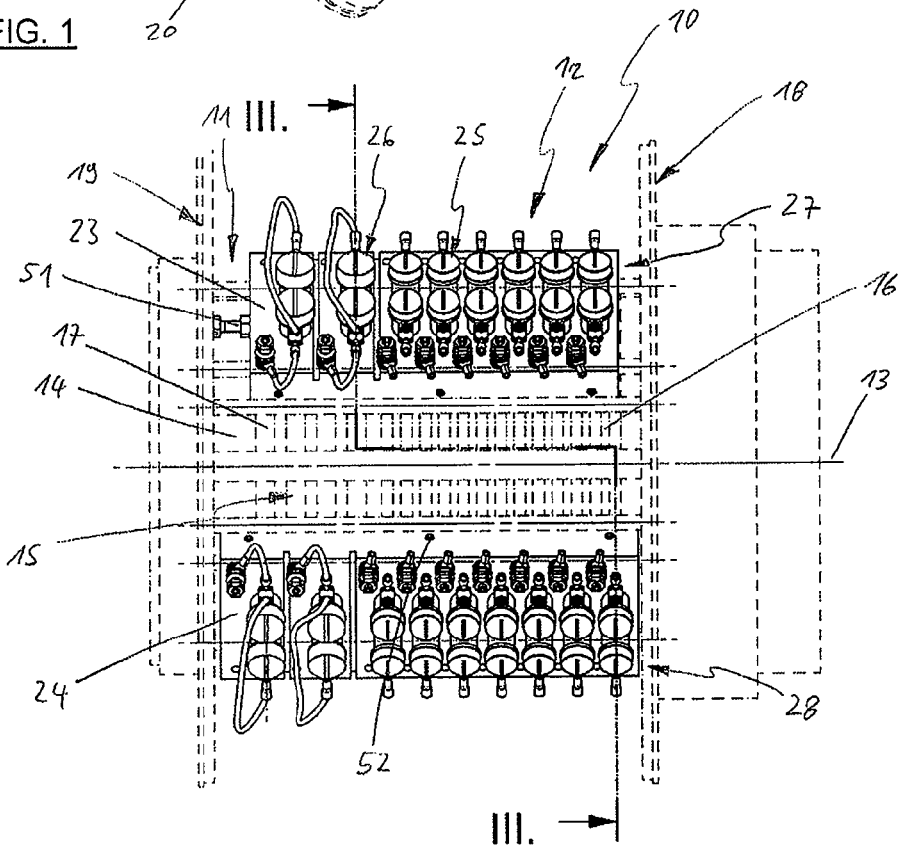
FIG. 2 shows an example of the contacting device with the rotor and the sliding contact retaining device of FIG. 1 in frontal view.
Figure 3:
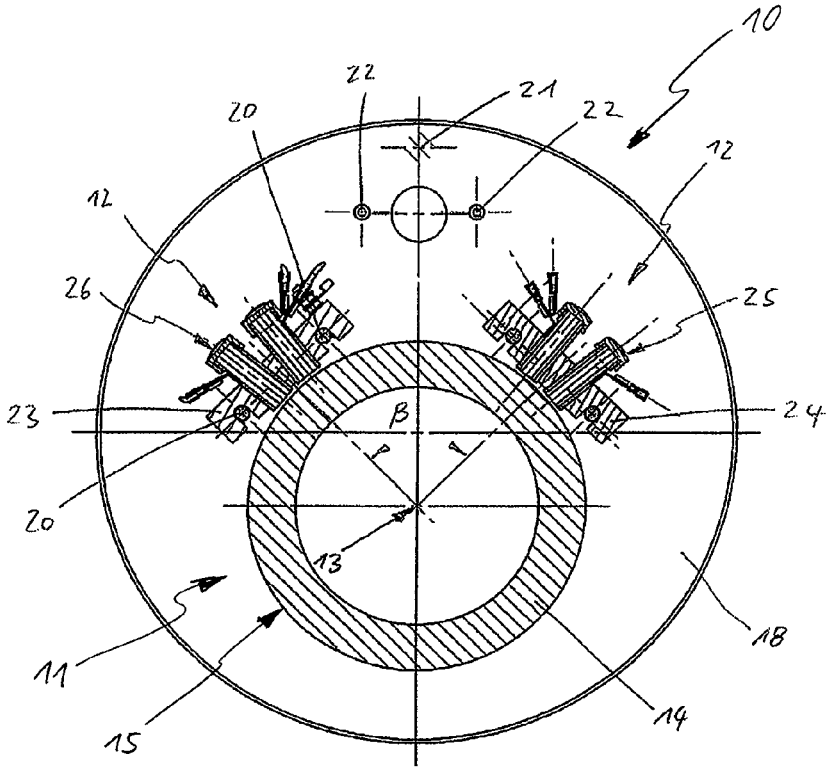
FIG. 3 shows an example of the contacting device with the rotor and the sliding contact retaining device in a cross-sectional view along line III-III of FIG. 2.
Figure 4:
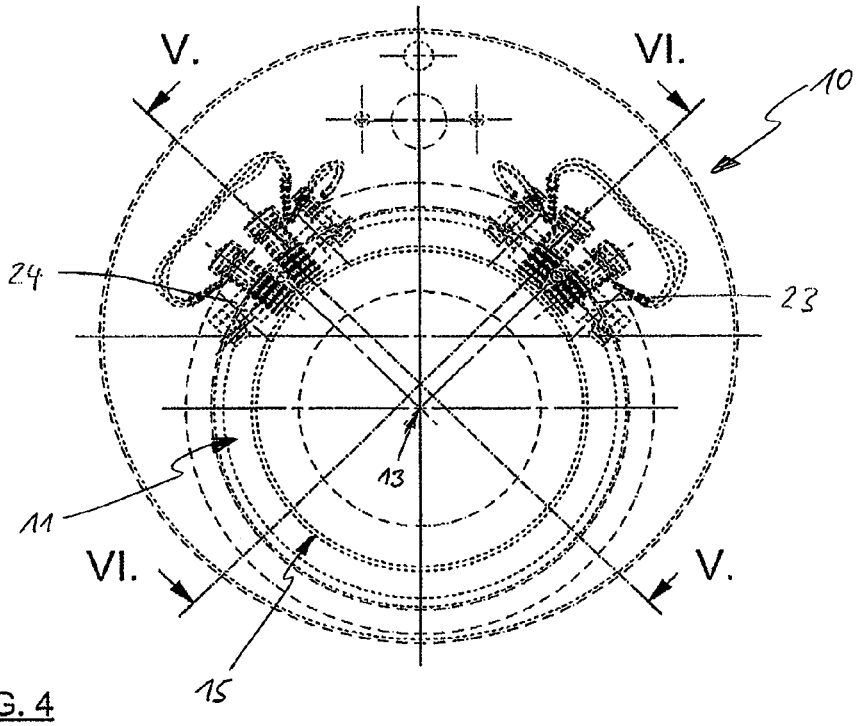
FIG. 4 shows an example of the contacting device with the rotor and the sliding contact retaining device of FIG. 1 in a lateral view.
Figure 5:
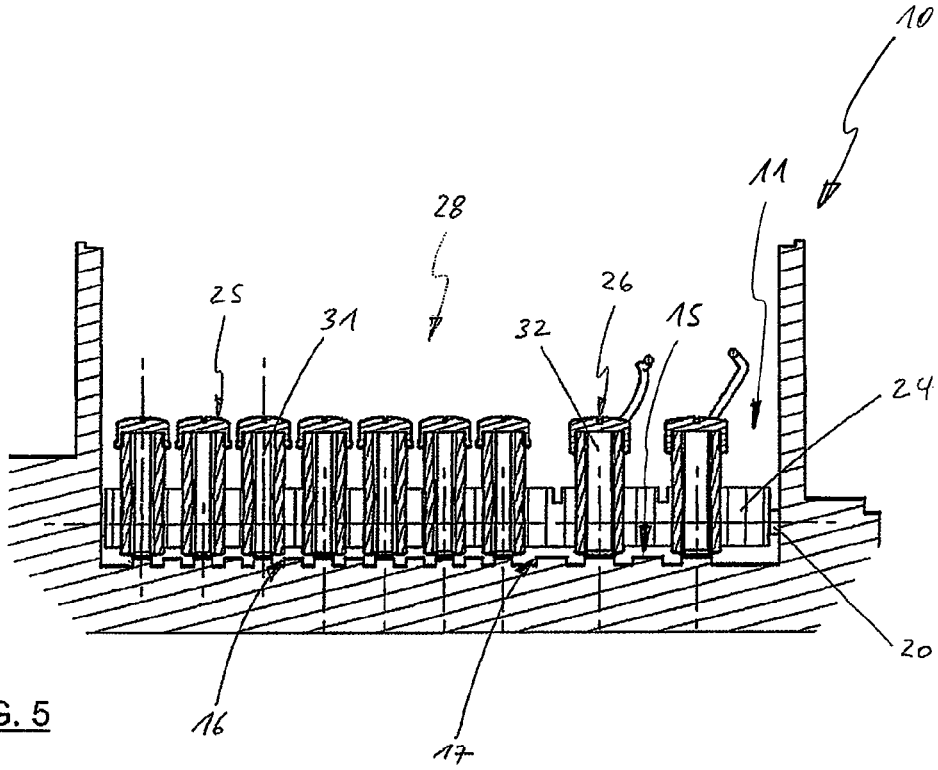
FIG. 5 shows an example of a partial cross-sectional view along line V-V of FIG. 4.
Figure 6:
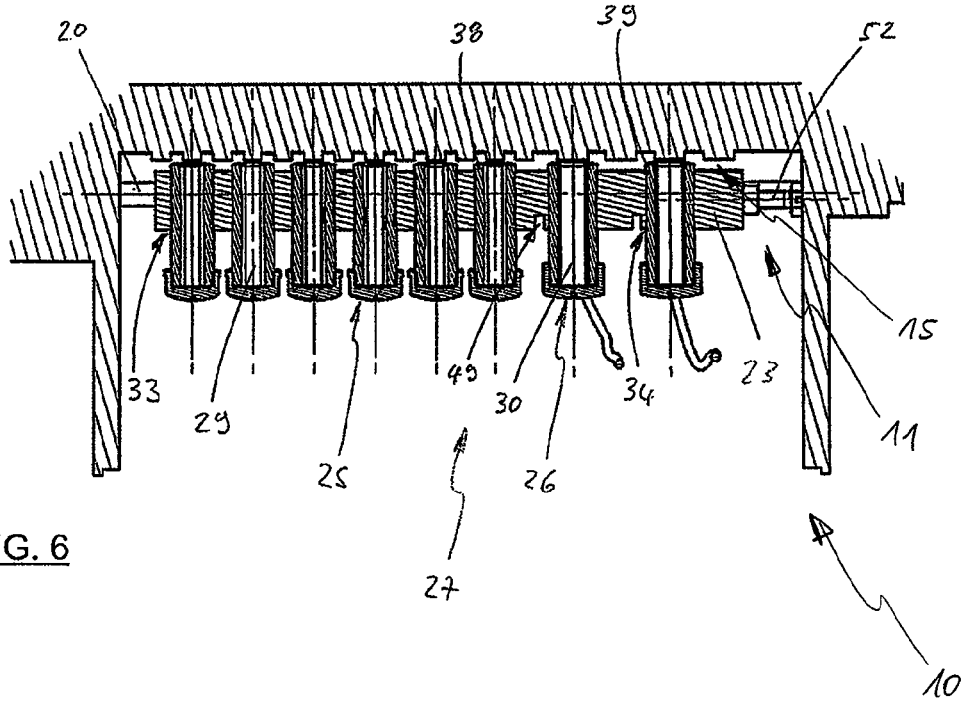
FIG. 6 shows an example of a partial cross-sectional view along line VI-VI of FIG. 4.

Viewing FIG. 1 to 6 as an entity illustrates an example of contacting device 10 for a rotor 11 jointly with a sliding contact retaining device 12 of the contacting device 10 in various perspective and sectional views. In an example, the contacting device 10 comprises the sliding contact retaining device 12, whereby irrelevant components of the contacting device 10 are illustrated here only in a simplified manner. The rotor 11 is likewise illustrated here only in a simplified manner for the purpose of better illustration, whereby in one applicable configuration, the rotor 11 surrounds a shaft, not shown here, which has jointly with the rotor 11 a joint rotational axis 13. On a rotational body 14 of the rotor 11, there is formed a slip ring arrangement 15 having a plurality of slip rings 17, which are electrically separated from one another. The slip rings 16 are formed comparatively small and the slip rings 17 comparatively large, whereby the slip rings 16 serve for the transmission of lower electric powers and the slip rings 17 for the transmission of higher electric powers. Between the respective slip rings 16 and 17 respectively, there can be disposed a dielectric material, which is not illustrated here in greater detail.

The contacting device 10 can include, among other things, two disc-shaped carrier plates 18 and 19, which can have carrier elements formed between the carrier plates as a rod 20, and further rods 21 and 22 serving for stabilization and fixing. The rotor 11 is rotatable relative to the contacting device 10, whereby in an installed situation, which is not shown here, for instance in a gondola of a wind turbine, the contacting device 10 can be arranged in a rotationally fixed manner.

The sliding contact retaining device 12 of the contacting device 10 has two holding devices 23 and 24 being formed of a dielectric plastic material. The holding devices 23 and 24 can each be equipped with a first set of sliding contact retainers 25 and a second set of sliding contact retainers 26. The sliding contact retainers 25 can serve for a contacting of the slip rings 16 and can be formed comparatively small in contrast to the sliding contact retainers 26 serving for contacting of the slip rings 17. The sliding contact retainers 25 and 26 can be arranged jointly in two first serial arrangements 27 parallel to the rotational axis 13 at the holding device 23, and in two second serial arrangements 28 likewise parallel to the rotational axis 13 at the holding device 24. The holding devices 23 and 24 can be additionally arranged in an axial direction between the carrier plates 18 and 19, in such a manner that adjacently arranged slip rings 16 and 17 respectively are contacted alternately from a sliding contact 29 and 30 respectively, which are illustrated here only in schematic view, of the first serial arrangement 27 and a second sliding contact 31 and 32 respectively of the second serial arrangement 28. Therefore, the serial arrangements 27 and 28 can be disposed in the axial direction staggered relative to one another, such that each serial arrangement 27 and 28 respectively contacts each second slip ring 16 and 17 respectively of the slip ring arrangement 15.

Figure 7:
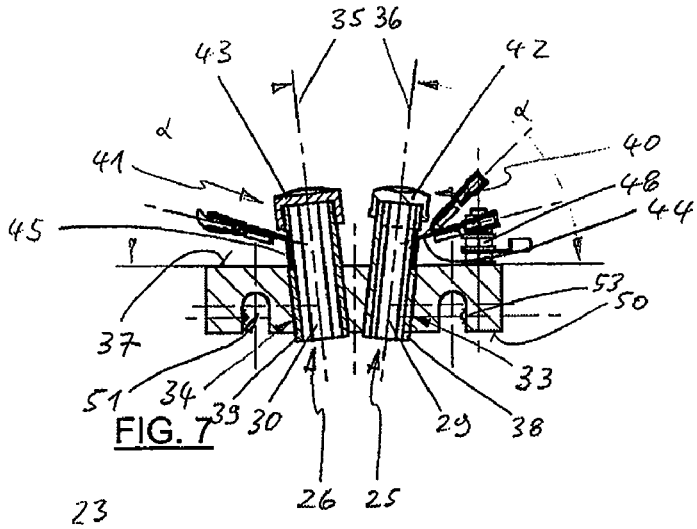
FIG. 7 shows an example of a cross-sectional view of a holding device of the sliding contact retaining device along line VII-VII of FIG. 9.
Figure 8:
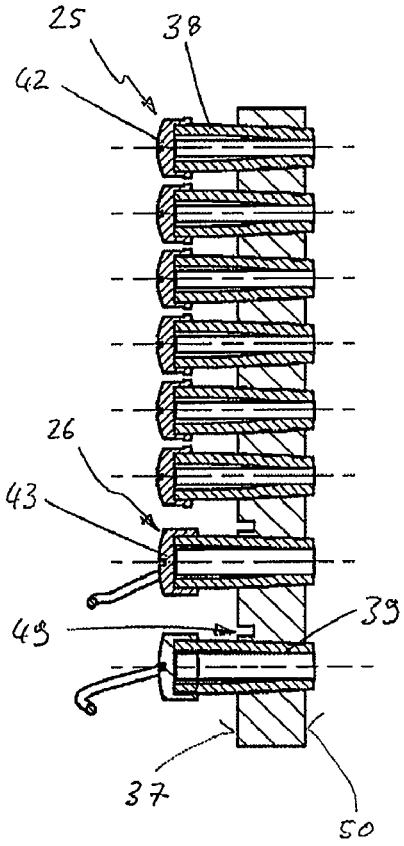
FIG. 8 shows an example of a longitudinal sectional view of the holding device of the sliding contact retaining device along line VIII-VIII of FIG. 9.
Figure 9:
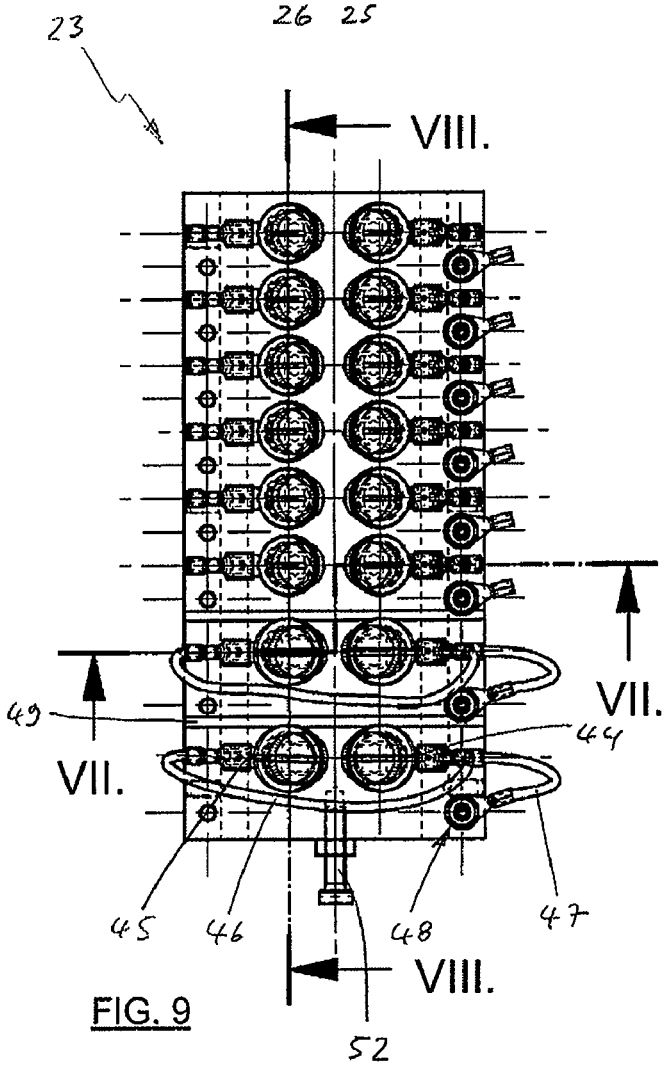
FIG. 9 shows an example of a plan view of the holding device of the sliding contact retaining device.

As can also be taken from the example of the illustration of the holding device 23 of FIGS. 7 to 9, the holding device 23 has sliding contact retainer receptacles formed as through holes 33 and 34 for receiving the sliding contact retainers 25 and 26 respectively. Longitudinal axes 35 and 36 of the sliding contact retainers 25 and 26 respectively are thus formed at an angle α relative to a surface 37 of the holding device 23, such that the longitudinal axes 35 and 36 intersect the rotational axis 13 in an installation position. The holding devices 23 and 24 are in turn arranged relative to one another at an angle β of basically 90° in relation to the rotational axis 13. The sliding contact retainers 25 and 26 are each formed of hollow profiles 38 and 39 respectively having an inner square, which is not illustrated here in greater detail, for receiving one of the sliding contacts 29, 30, 31 and 32 respectively, whereby upper ends 40 and 41 of the sliding contact retainers 25 and 26 respectively are provided with a thread, which is not shown here, and are closed by means of a screw cap 42 and 43 respectively. Because of the resulting dimensions of the hollow profiles 38 and 39 as well as of the distances to be kept between the hollow profiles 38 and 39 respectively to prevent flashovers, a contacting of adjacent slip rings 16 and 17 respectively in a single serial arrangement may not be feasible. At the hollow profiles 38 and 39 made of brass, there is a blade terminal 44 and 45 each closely bonded thereto. As can be seen from the example of the sliding contact retainers 26, the blade terminals 45 serve for connecting the hollow profiles 39 by means of a conductor 46, whereby another conductor 47 contacts a screw connection 48. The screw connections 48 serve for connecting the sliding contact retaining device 12 to supplies, which are not shown here. On the surface 37, there are provided further grooves 49 supposed to serve for enlarging of a surface distance between the sliding contact retainers 25 and 26 respectively, thereby preventing unwanted leakage currents. On one surface 50 of the respective holding devices 23 and 24 respectively, which faces the slip ring arrangement 15, there are provided two parallel extending grooves 51 serving for receiving the rods 20, and thus for axially displaceable mounting of the holding devices 23 and 24 respectively. An adjustment of the axial position of the holding device 23 is performed by means of a screw 52 inserted into the holding device 23, which forms an arrester. As is apparent from the example of the holding device 23, there are further screws 53 provided in the holding devices 23 and 24, which enable a tight fixing of the holding devices 23 and 24 respectively at the rods 20 by clamping.

For replacement of a sliding contact, it is merely necessary to remove the relevant screw caps 42 and 43 respectively from the hollow profiles 38 and 39 respectively, and to remove the sliding contacts 29, 30, 31 and 32 respectively and replace them by new sliding contacts. Thus, replacement of a sliding contact can easily be performed in situ, e.g., without the need for more comprehensive mounting work. It is also feasible to perform replacement of sliding contacts outside of an operational area of the contacting device 10. Easy replacability is particularly useful if an operational area is a gondola of a wind turbine. In this case, mounting work has to be performed in a very small area and under potentially unfavourable weather conditions. In this case, the entire sliding contact retaining device 12 can be removed from the contacting device 10 by loosening of the screws 53 and of the screw connections 48.

The invention claimed is:

1. Sliding contact retaining device for a contacting device of a rotor, wherein the rotor has a plurality of slip rings, wherein the sliding contact retaining device is configured to be engaged with the contacting device, and wherein an electrical contact can be established between the slip rings of the rotor and sliding contacts of the sliding contact retaining device, wherein using the sliding contact retaining device, sliding contact retainers are disposed in a first and a second serial arrangement parallel to a rotational axis of the rotor, and wherein adjacently arranged slip rings can be contacted alternately from a sliding contact of the first serial arrangement and a sliding contact of the second serial arrangement, wherein the sliding contact retaining device comprises at least one holding device for receiving at least two serial arrangements of sliding contact retainers.

2. Sliding contact retaining device of claim 1, wherein the sliding contact retaining device includes at least two holding devices.

3. Sliding contact retaining device of claim 2, wherein the holding devices are arranged relative to one another at a radial angle β in relation to the rotational axis.

4. Sliding contact retaining device of claim 2, wherein each holding device forms a first and a second serial arrangement.

5. Sliding contact retaining device of claim 2, wherein each holding device forms two first or two second serial arrangements.

6. Sliding contact retaining device of claim 5, wherein at the holding device there is provided a joint supply connection for sliding contact retainers in contact with the same slip ring.

7. Sliding contact retaining device of claim 1, wherein the holding device is arranged in installation position above the rotational axis.

8. Sliding contact retaining device of claim 1, wherein the holding device is formed of a dielectric material.

9. Sliding contact retaining device of claim 1, wherein the holding device is formed in one piece.

10. Sliding contact retaining device of claim 1, wherein the holding device forms sliding contact retaining receptacles for receiving the sliding contact retainers.

11. Sliding contact retaining device of claim 10, wherein the sliding contact retaining receptacles of the holding device respectively comprise through holes.

12. Sliding contact retaining device of claim 10, wherein the sliding contact retaining receptacles of the holding device are formed such that a longitudinal axis of the sliding contact retaining receptacle intersects the rotational axis.

13. Sliding contact retaining device of claim 1, wherein the sliding contact retainers include a housing, which comprises a hollow profile.

14. Sliding contact retaining device of claim 13, wherein the housing is electrically conductive and that a connection is formed at the housing.

15. Sliding contact retaining device of claim 1, wherein the holding device comprises a fixing device for fixing the holding device at carrier elements of the contacting device.

16. Sliding contact retaining device of claim 15, wherein the fixing device forms axially extending grooves in a surface of the holding device, in which the carrier elements of the contacting device can be inserted.

17. Sliding contact retaining device of claim 15, wherein the fixing device forms fixing holes in the holding device, which permit a detachable fixing of the holding device at the carrier elements.

18. Sliding contact retaining device of claim 1, wherein the holding device comprises an adjusting device for adjusting an axial position of the sliding contacts relative to the slip rings.

19. Sliding contact retaining device according to claim 1, wherein the holding device comprises grooves, on a surface, that extend between sliding contact retainers.

* * * * *

UNITED STATES PATENT AND TRADEMARK OFFICE

CERTIFICATE OF CORRECTION

PATENT NO. : 7,744,374 B2
APPLICATION NO. : 12/200536
DATED : June 29, 2010
INVENTOR(S) : Peter Hoelscher et al.

It is certified that error appears in the above-identified patent and that said Letters Patent is hereby corrected as shown below:

On the title page, in item (30), under "Foreign Application Priority Data", in column 1, line 1, delete "102008039862" and insert -- 102008039862.4 --, therefor.

On the title page, in item (56), under "U.S. Patent Documents", in column 2, line 4, delete "Engelenburg et al." and insert -- v Engelenburg et al. --, therefor.

Signed and Sealed this

Fourteenth Day of September, 2010

David J. Kappos

David J. Kappos
*Director of the United States Patent and Trademark Office*